US012747402B2

(12) United States Patent
Odjo et al.

(10) Patent No.: US 12,747,402 B2
(45) Date of Patent: Sep. 29, 2026

(54) METHOD OF UPGRADING HIGHLY OLEFINIC OILS DERIVED FROM WASTE PLASTIC PYROLYSIS

(71) Applicant: Clean Planet Energy, London (GB)

(72) Inventors: Andrew Odjo, London (GB); Bertie Stephens, London (GB); Ridwan Choudhury, London (GB); Christine Loehaaversen, London (GB); Daniel Odjo, London (GB)

(73) Assignee: Clean Planet Energy, A Trading Name of Pyroplast Energy Ltd, London (GB)

( * ) Notice: Subject to any disclaimer, the term of this patent is extended or adjusted under 35 U.S.C. 154(b) by 175 days.

(21) Appl. No.: 18/696,328

(22) PCT Filed: Sep. 28, 2022

(86) PCT No.: PCT/GB2022/052461

§ 371 (c)(1),
(2) Date: Mar. 27, 2024

(87) PCT Pub. No.: WO2023/052765

PCT Pub. Date: Apr. 6, 2023

(65) Prior Publication Data

US 2025/0368904 A1 Dec. 4, 2025

(30) Foreign Application Priority Data

Sep. 28, 2021 (GB) ..... 2113820

(51) Int. Cl.
*C10G 65/12* (2006.01)

(52) U.S. Cl.
CPC ..... *C10G 65/12* (2013.01); *C10G 2300/1003* (2013.01)

(58) Field of Classification Search
CPC ..... C10G 65/12; C10G 2300/1003
See application file for complete search history.

(56) References Cited

U.S. PATENT DOCUMENTS

2023/0029587 A1* 2/2023 Weiss ..... C10G 1/10

FOREIGN PATENT DOCUMENTS

| | | | | |
|---|---|---|---|---|
| EP | 0541871 A1 | 5/1993 | | |
| FR | 3107530 A1 | 8/2021 | | |
| WO | WO-2018055555 A1 * | 3/2018 | ..... | C10K 1/103 |
| WO | WO-2018127812 A1 * | 7/2018 | ..... | C07C 2/66 |

* cited by examiner

*Primary Examiner* — Prem C Singh
*Assistant Examiner* — Juan C Valencia
(74) *Attorney, Agent, or Firm* — Womble Bond Dickinson (US) LLP

(57) ABSTRACT

A two-stage process of waste plastics pyrolysis oil upgrading via hydroprocessing is described. The process involves combining hydrogen gas with a highly-olefinic pyrolysis oil liquid feed and a saturated near zero olefins stream to form an attenuated feed stream to a first hydroprocessing reactor; contacting the attenuated feed stream with a series of hydroprocessing catalysts in a two-stage process with at least two hydroprocessing reactors; and splitting the first stage reactor product, which is a saturated near zero olefins stream, into at least two portions. A first portion serves as the attenuation stream in the process and a second portion serves as feed to the second stage.

10 Claims, 4 Drawing Sheets

METHOD OF UPGRADING HIGHLY OLEFINIC OILS DERIVED FROM WASTE PLASTIC PYROLYSIS

CROSS-REFERENCE TO RELATED APPLICATIONS

The present application is a U.S. National Stage of International Patent Application PCT/GB2022/052461, filed Sep. 28, 2022 and claims priority to GB2113820.1, filed Sep. 28, 2021. The disclosures of each of the applications noted above are incorporated herein by reference in their entirety.

TECHNICAL FIELD OF THE INVENTION

The present invention belongs to the general technical field of chemical engineering, more particularly to the technical field of mixed waste plastic recycling by pyrolysis to produce commercial grade fuels by upgrading the pyrolysis oil using oil refining technologies.

BACKGROUND TO THE INVENTION

Plastic waste is nowadays a major environmental problem in developed societies. Plastic waste occupies a large volume in landfills due to its low bulk density. Landfill space is increasingly scarcer in developed countries and therefore the amount of plastic waste to be deposited in landfills needs to be minimised. Mixed plastic waste, as it is recovered from domestic refuse sorting, is difficult to reuse or recycle because of the diversity of plastics it contains and the level of impurities present in it. There are limited options to deal with mixed plastic waste, including export to third countries or its transformation into fuel by pyrolysis.

Third countries are increasingly reluctant to accept plastic waste from developed countries, and therefore, the option of converting mixed waste plastic into fuels becomes not only a need but it could also be an opportunity to reduce our reliance in crude oil derived fuels, at the same time as reducing waste plastic pollution in worldwide habitats, such as our oceans.

Currently there are some operators that recycle mixed waste plastic by pyrolysis to produce pyrolysis oil derived thereof and sell it as it comes directly from the pyrolysis unit with little or no post-processing. Raw or unprocessed pyrolysis oil derived from waste plastic presents a number of problems or disadvantages:

- Low quality in terms of pour point, ignition point, lubrication, etc.;
- Have low market value;
- Contains high olefins content (35-75% v/v);
- Present high safety risks during conventional hydroprocessing, since these oils exhibit very high degree of exotherm due to the high heat of olefins saturation reaction under hydroprocessing conditions, leading to extreme temperature rise and potential temperature excursions/runaway;
- Contain high levels of impurities such as metals contents from plastics coatings, paints and additives (waste plastics pyrolysis oils with levels of silica as high as 2500 ppm has been obtained);
- Contains high oxygenates contents (from the polycarbonates and PET fraction of the waste plastics feedstock) which generally reduces the oils' stability;
- Possess great challenges in its hydroprocessing as a full range oil since these oils typically consist of a lighter boiling fraction, a medium boiling fraction and a heavy boiling fraction; co-hydroprocessing of these fractions would typically result in sub-optimal product distribution since different fractions of the oil would require different operating conditions and catalysts;
- Are very waxy (up to 70% wax content), contributing to its poor transport properties, poor handling and storage;
- Unlike fossil-based crude oils, are highly inconsistent in properties. Specifically, pyrolysis oils from waste plastics possess wide variability and inconsistency in the paraffins, iso-paraffins, olefins, naphthenes and aromatics (PIONA) contents due to the highly variable and inconsistent composition of the waste plastic feedstock used for the production of these oils. These inconsistencies render the oils highly unpredictable and hence less attractive to end users.

All of the above drawbacks make waste plastic derived pyrolysis oil a low market value fuel, which in turn, makes mixed waste plastic recycling an unattractive process for investors to fund and therefore, the mixed plastic waste problem remains unsolved in a scenario of highest ever necessity for it to be addressed, due to the continually increasing volumes of waste plastic generated and the currently decreasing options for its export.

Current attempts at upgrading waste plastic pyrolysis oil face the problem of its high reactivity due to its high olefinicity, i.e., a high amount of unsaturated or double bond containing compounds. This manifests itself generally in problems of heat management in oil upgrading reactors which could lead to further problems such as runaway reactions, quick catalyst deactivation, variable product properties, etc. in turn resulting in unsafe and/or uneconomic processes.

SUMMARY OF THE INVENTION

According to a first aspect of the invention there is provided a method of waste plastics pyrolysis oil upgrading via hydroprocessing comprising the steps of:

a) combining a highly-olefinic pyrolysis oil liquid feed with hydrogen gas and a saturated near zero-olefins stream, also known as attenuation stream, to form an attenuated feed stream to a first hydroprocessing reactor, b) contacting the attenuated feed stream with a series of hydroprocessing catalysts in a two-stage process with at least two hydroprocessing reactors, wherein a first reactor series of at least one reactor operates in the first stage at a lower temperature and/or pressure in order to mainly saturate double-bonds and at least one second reactor, which operate(s) in the second stage, at higher temperature and/or pressure, in order to mainly remove heteroatomic compounds;

c) splitting the first stage reactor product, which is a saturated near-zero olefins stream, into at least two portions by flashing it on a separator vessel; wherein a first portion serves as the attenuation stream in step a), and a second portion serves as feed to the second stage.

With this pyrolysis oil upgrading method it is possible to have a better heat management in the first reactor due to the fact that the overall olefinicity of the reactor feed is decreased by dilution with a portion of the reactor effluent. This means that the reactor tendency to overheat is reduced and therefore a better and more accurate reactor temperature control can be achieved, thus resulting in a more uniform product and a more prolonged catalyst lifespan, while reducing the probability of runaway reactions.

In this process, the first stage serves principally for metals removal and olefins saturation via hydrodemetallisation and hydrodeolefinisation respectively, while the second stage serves principally for sulfur, nitrogen, oxygen removals, aromatics saturation, cracking, dewaxing and isomerisation via hydrodesulphurisation, hydrodeoxygenation, hydrodearomatisation, hydrocracking, hydrodewaxing and hydroisomerisation reactions correspondingly.

Preferably, the proportion of the saturated near-zero-olefins attenuation stream to the unsaturated highly olefinic stream is between 1 to 1 and 10 to 1 in weight.

The higher the proportion of the saturated stream mixing with the fresh feed, the greater the reduction in the potential temperature excursion in the reactor, thus reducing the safety risk and potential for temperature runaway. Also, it improves the catalyst life by reducing the severity of the catalyst operation and likelihood of catalyst deactivation.

Preferably, the mass flow of the feed to the second stage is similar or as close as possible to the mass flow of the incoming unsaturated highly olefinic feed.

Preferably, the unsaturated highly olefinic pyrolysis oil liquid feed may mainly comprise pyrolysis or synthetic oil from waste plastics. Optionally, the unsaturated highly olefinic pyrolysis oil liquid feed may comprise a minority part (i.e. less than 50% wt) of pyrolysis or synthetic oil from biogenic feedstock and/or fossil-based hydrocarbon oil.

In this context, highly olefinic refers to oils with between 25 to 85% wt olefins content and "near zero-olefins" refer to between 0 to 10% wt olefins content.

Preferably, the step of splitting the first stage reactor product yields a third portion that serves as liquid quench, after cooling, for the temperature control within the first stage reactor(s).

Preferably, the attenuated feed stream comprises at least a portion of the hydrogen gas dissolved in the attenuated feed stream, with non-dissolved hydrogen gas comprising between 0.1 to 0.99 volume fraction of the attenuated feed stream.

Hydrogen is required for the reaction purposes, but also works to reduce the formation of coke on the catalyst, thus increasing the catalyst lifespan. Higher hydrogen partial pressure also improves the cetane number, increases aromatic saturation, etc.

Preferably, the step of contacting the attenuated feed stream with a series of hydroprocessing catalysts in a two-stage process with at least two hydroprocessing reactors comprises maintaining a liquid mass flux within the reactors of at least 1 kg/s-m2 to 5 kg/s-m2 to form a hydroprocessed product.

Preferably, the method comprises providing a system of catalysts in the at least one second stage hydroprocessing reactor comprising one or more of the following: a hydrotreating catalyst, for hydrodesulphurisation (or sulphur removal), hydrodenitrogenation (or nitrogen removal), hydrodearomatisation (for aromatics saturation), hydrodeoxygenation (or oxygen removal), a hydrocracking catalysts, for the cracking of the higher molecular weight higher hydrocarbon chain compounds into smaller hydrocarbon chain compounds for the improvement of the oil's chemical and transport properties, and/or a hydroisomerisation catalyst, for the dewaxing via isomerisation of the oil's longer chain paraffins, thereby further improving the oil's chemical and physical properties.

Figure 1:
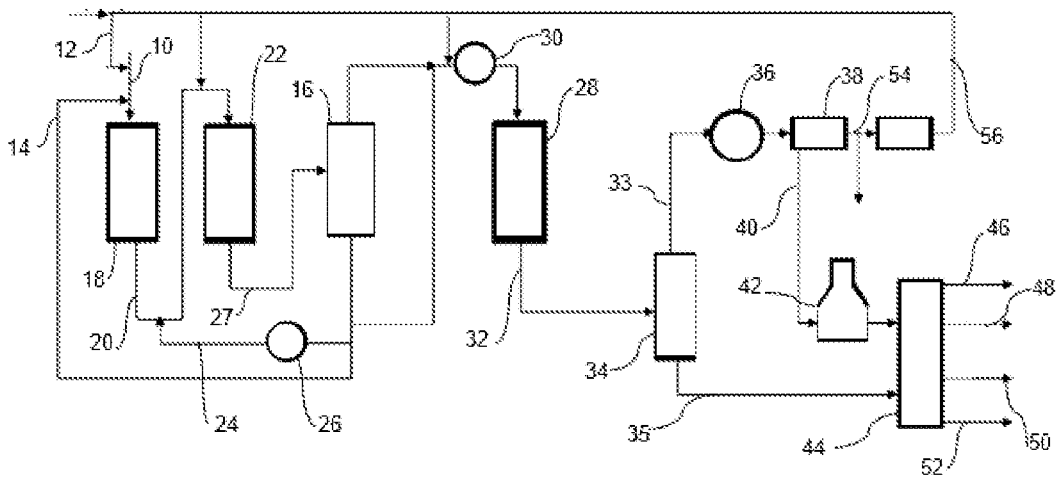
FIG. 1 is a flow diagram of a process according to a first embodiment of the invention.

For clarity of presentation, not all line items and equipment such as process coolers, heaters, heat exchangers, pumps, vessels, etc, have been depicted on the flow diagrams.

DETAILED DESCRIPTION OF THE INVENTION

The process or method according to the present invention involves the treating of a waste plastics derived pyrolysis oil in a system of multiple hydroprocessing reactors, whereby the hydroprocessing is separated in two stages. Stage 1 operates at a lower temperature for olefin saturation and demetallization, also allowing for a minimization of cracking in Stage 1, and Stage 2 operates at a higher temperature for the removal of sulfur, aromatics, nitrogen and oxygenate compounds in the pyrolysis oil feed, as well as for hydrocracking and hydrodewaxing/hydroisomerisation.

The process involves the addition of a saturated diluent (saturated low olefinic stream with a near-zero olefin content), also called attenuated stream, to the fresh high-olefin stream derived from waste plastic feedstock via pyrolysis fed to the first stage (Stage 1) hydroprocessing reactors system, and optionally, well as the use of the same saturated diluent material to quench the reactor effluent to control the temperature and reduce the hydrogen consumption in Stage 1.

Specifically, a fresh pyrolysis oil feed, after mixing with the recycled saturated diluent or attenuated stream, is preheated and sent to the Stage 1 reactors (where the primary reactions are olefin saturation and demetallisation). The saturated diluent is recycled via a first stage separator vessel located downstream the Stage 1 reactors—and mixed with the fresh feed. The blending of the fresh unsaturated highly olefinic pyrolysis oil feed with a saturated stream acting as diluent (attenuated stream), reduces the olefinic content in the total feed stream to the Stage 1 reactors and thereby reduces the degree of exotherm in the reactors. Feed from the guard reactor (first reactor) effluent is cooled, using either liquid quench or an intercooler.

The liquid quench is the same material as the recycle saturated diluent (attenuated stream), however it is cooled further in a cooler to act as a quench. The recycled saturated diluent (attenuated stream) is not cooled and acts as a source of heat for the fresh feed, reducing the required heating for the fresh feed to the reactors.

The operating conditions of temperature, pressure, hydrogen to oil ratio, liquid hourly space velocity (LHSV), Weighted Average Bed Temperature (WABT), temperature rise and catalyst type are selected such that the fraction or all of the olefins in the fresh feed is saturated in the first reactor of Stage 1.

In cases where a fraction of the olefins is saturated in the first reactor (or first bed for multi-bed reactor cases), the first reactor effluent is then sent to the next reactor or to the next catalyst bed within the same reactor within Stage 1, where the same reactions occur, leading to a sequential saturation of the olefins from reactor to reactor or bed to bed all within Stage 1. The effluents from the reactors or beds in Stage 1 is cooled via direct mixing with a liquid quench or with intercoolers. The liquid quench is essentially a cooled fraction of the recycled saturated diluent. At the final reactor, the effluent, is sent to a first stage separator vessel, where the liquid and gas phases are separated. A portion of the liquid is recycled back to serve as inter-reactor or inter-bed quench and as diluent (attenuated stream) for the fresh pyrolysis oil feed. The remainder, whose amount is selected such that the overall flow equates to the incoming fresh feed flowrate, is sent forward to the Stage 2 reactors.

The gas phase from the separator overhead is either routed to the recycle hydrogen compressor via a $H_2S$ removal scrubber or $H_2$ purification unit, or mixed with the portion of the liquid phase routed to the Stage 2 reactors. The feed stream to Stage 2 is optionally preheated en-route to the first reactor of Stage 2. In the Stage 2 reactors, the following reactions occur: further hydrodesulfurization, hydrodenitrification, hydrodeoxygenation, hydrodearomatisation, hydrocracking, and dewaxing/hydroisomerisation. Optionally, the effluent from the final reactor of Stage 2 exchanges heat with the saturated diluent/fresh feed mixed stream for further heat integration.

According to our knowledge, the use of diluent recycle feed to attenuate highly olefinic fresh waste plastic pyrolysis oil for the upgrade of this types of oil has not been carried out previously. There are different processes available for hydrotreating pyrolysis oils but none that uses a portion of the saturated partial product to attenuate the high olefins content in the feed, ensuring that the olefin concentration in the fresh feed is reduced and thereby reducing the degree of exothermicity of the olefin saturation reactions in the reactors. Use of liquid quench as a substitute for hydrogen quench also reduces the consumption of hydrogen, which is an advantage economically. Liquid quench is vastly different to standard gas quench used in conventional hydroprocessing.

Several embodiments of the invention will be described in detail below:

With reference to FIG. 1, the flow diagram illustrates the method according to a first embodiment of the invention.

The diagram shows that a highly-olefinic pyrolysis oil liquid feed 10 is mixed with a recycled gas stream 12, which is mainly composed of hydrogen and also contains other gases in very small quantities, and then with an attenuation stream 14 of near-zero olefin hydrocarbons coming from the first-stage flash separator 16 and routed to the guard bed reactor 18.

Effluent 20 from the guard bed reactor 18 is routed to the hydro-deolefination reactors 22 after being mixed with cold liquid quench 24 to cool the reactor effluent 20. The liquid quench stream 24 is provided from the first-stage separator 16 via an air cooler 26.

There is one hydro-deolefination reactor 22 in this embodiment (but there could be several hydrodeolefination reactors in series or in parallel) and recycle hydrogen is added at the inlet to each reactor. The outlet 27 from the hydro-deolefination reactor 22 is sent directly to the first-stage separator 16, where the flashed gas and liquid are sent to the hydrotreating/hydrocracking reactors 28. Pre-heating via a heat-exchanger 30 is required before entering the hydrotreating/hydrocracking reactors 28, as well as addition of recycle gas, which is mainly hydrogen.

Effluent 32 from the hydrotreating/hydrocracking reactor 28 is sent to the second-stage separator 34. In this embodiment there is a single hydrotreating/hydrocracking reactor 28 (in other embodiments there are several hydrotreating/hydrocracking reactors in series or in parallel, and hydrogen would be used as quench between each hydrotreating/hydrocracking reactor in series).

Vapor 33 from the second-stage separator 34 is sent to a hot vapor air cooler 36 and then to a cold separator 38. Liquid 40 from the cold separator 38 is heated up via a fired heater 42 and sent to a distillation column 44. Liquid 35 from the second-stage separator 34 is also sent to the distillation column 44. Off-gas 46, naphtha 48, diesel 50 and fuel oil 52 are products from the distillation column 44. Vapor 54 from the cold separator is purified and compressed back as recycle gas 56 to the reactors 22, 28.

The advantages of this embodiment are that use of liquid quench 24 reduces the hydrogen consumption in the reactor. Liquid quench 24 also provides greater heat capacity. The attenuating stream 14 reduces the olefin concentration in the reactor feed and therefore reduces the degree of exotherm of the olefin saturation reactions in the reactor. This also acts as an effective temperature control. Overall, the heat management of the process is improved and the hydrogen consumption is reduced.

In the case there would multiple hydro-deolefination and/or hydrotreating/hydrocracking reactors, there would be additional significant CAPEX to the project. More plot space would be required and this would imply higher maintenance costs.

Figure 2:
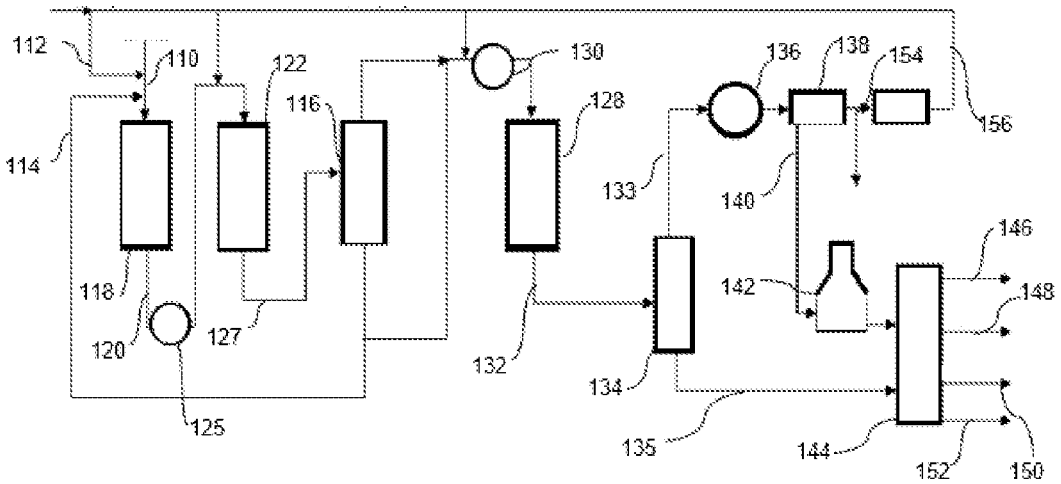
FIG. 2 is a flow diagram of a process according to a second embodiment of the invention.

With reference to FIG. 2, the flow diagram illustrates the method according to a second embodiment of the invention, which is very similar to the first embodiment of invention and wherein like elements are indicated by like numerals incremented by 100. For example, the guard reactor in FIG. 1 is 18 and 118 in FIG. 2.

The only difference between the embodiment in FIG. 1 and the embodiment in FIG. 2 is that in FIG. 2 there is no liquid quench stream between the first-stage separator 116 and into the guard reactor effluent stream 120 and instead, the guard reactor 18 effluent 120 is cooled by an intercooler 125.

The advantage of this embodiment is that the attenuating stream 114 reduces the olefin concentration in the reactor feed and therefore reduces the degree of exotherm of the olefin saturation reactions in the reactor. This also acts as an effective temperature control. Intercoolers between first-stage reactors are used for a more effective control of temperature rise given the lesser complexity compared to injecting liquid quench and having adequate mixing. Overall, the heat management of the process is improved and the hydrogen consumption is reduced.

In the case there would be multiple hydro-deolefination and/or hydrotreating/hydrocracking reactors, there would be additional significant CAPEX to the project. More plot space would be required and this would imply higher maintenance costs. Besides, CAPEX increases due to acquisition of air/water intercoolers.

Figure 3:
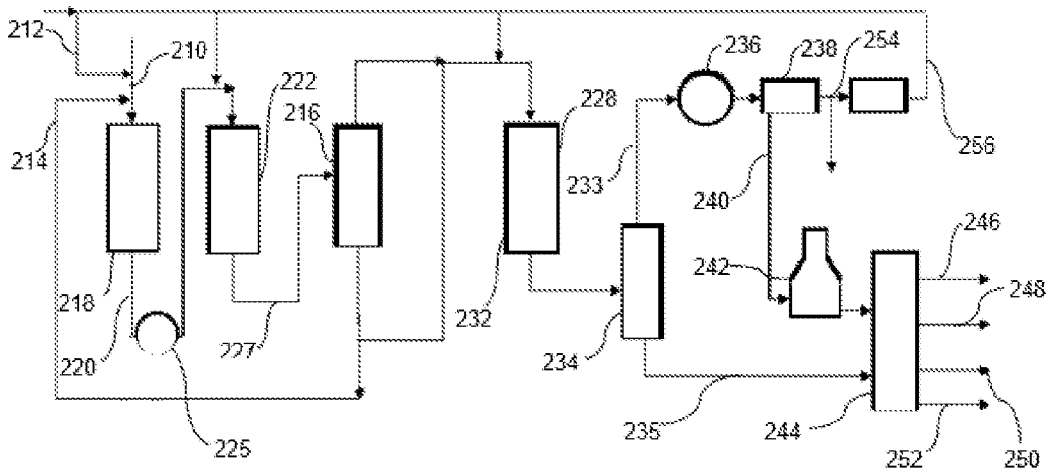
FIG. 3 is a flow diagram of a process according to a third embodiment of the invention.

With reference to FIG. 3, the flow diagram illustrates the method according to a third embodiment of the invention, which is very similar to the first and second embodiments of invention and wherein like elements are indicated by like numerals incremented by 200 and 100, respectively. For example, the guard reactor in FIG. 1 is 18, in FIG. 2 is 118 and 218 in FIG. 3.

The only difference between the embodiment in FIG. 2 and the embodiment in FIG. 3 is that in FIG. 3 there is no pre-heating via a heat-exchanger before entering the hydrotreating/hydrocracking reactor 228, contrary to what happens in FIG. 2.

In this third embodiment, since there is no pre-heater before the hydrotreating/hydrocracking reactor, this reactor operates at a lower temperature and reduced activity, possibly resulting in off-spec product.

Figure 4:
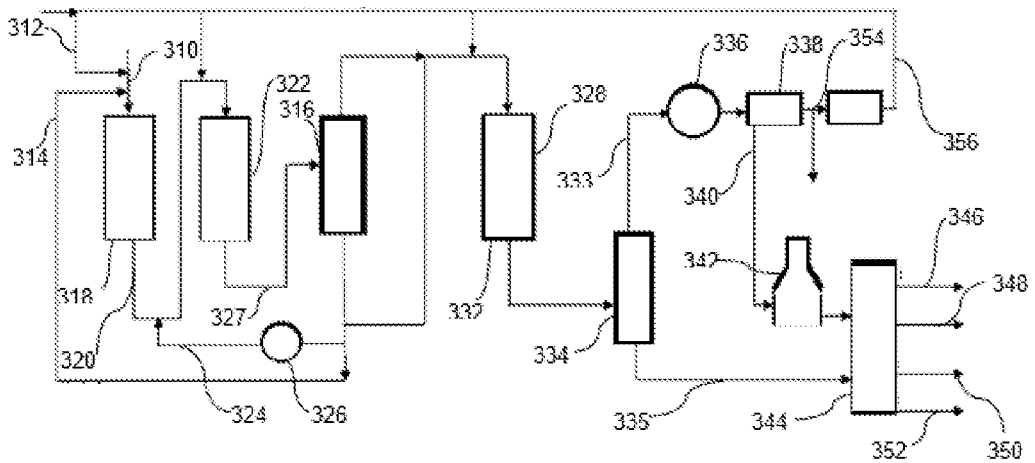
FIG. 4 is a flow diagram of a process according to a fourth embodiment of the invention.

With reference to FIG. 4, the flow diagram illustrates the method according to a fourth embodiment of the invention, which is very similar to the first, second and third embodiments of invention and wherein like elements are indicated by like numerals incremented by 300, 200 and 100, respectively. For example, the guard reactor in FIG. 1 is 18, in FIG. 2 is 118, in FIG. 3 is 218 and is 318 in FIG. 4.

The only difference between the embodiment in FIG. 1 and the embodiment in FIG. 4 is that in FIG. 4 there is no pre-heating via a heat-exchanger before entering the hydrotreating/hydrocracking reactor 328, contrary to what happens in FIG. 1.

The only difference between the embodiment in FIG. 3 and the embodiment in FIG. 4 is that in FIG. 4 there is no intercooler between the guard reactor 318 and the reactor 322 and instead there is a liquid quench stream 324 into the guard reactor effluent stream 320.

The advantages of this embodiment are that use of liquid quench 324 reduces the hydrogen consumption in the reactor. Liquid quench 324 also provides greater heat capacity. However, since in this fourth embodiment there is no pre-heater before the hydrotreating/hydrocracking reactor 328, this reactor operates at a lower temperature and reduced activity, possibly resulting in off-spec product.

Figure 5:
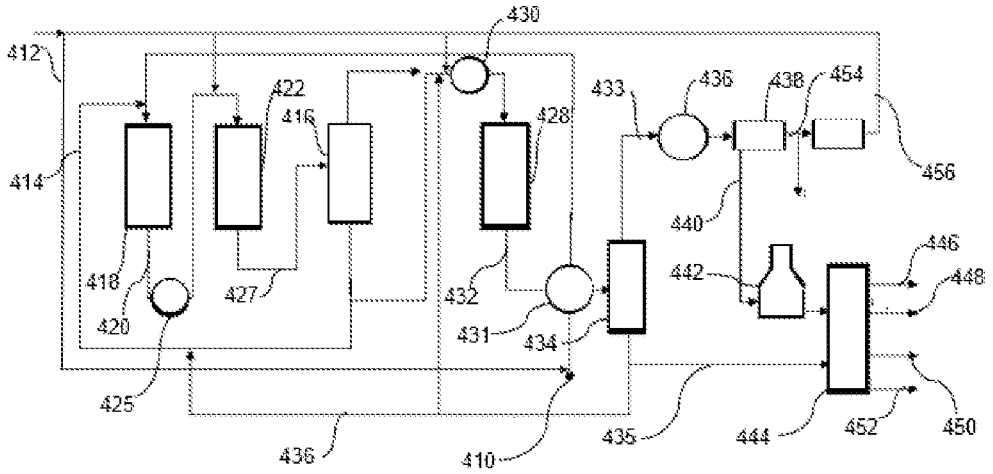
FIG. 5 is a flow diagram of a process according to a fifth embodiment of the invention.

With reference to FIG. 5, the flow diagram illustrates the method according to a fifth embodiment of the invention, which is very similar to the second embodiment of invention and wherein like elements are indicated by like numerals incremented by 300. For example, the guard reactor in FIG. 2 is 118, and is 418 in FIG. 5.

There are a few differences between the embodiment in FIG. 2 and the embodiment in FIG. 5.

The main difference is that in FIG. 5 there is a second stage recycle stream, i.e., the effluent stream of the second stage separator 434 is divided in two streams 435, 436: one effluent stream 435 is sent to the distillation column 444 for separation into product streams and the other effluent stream 436 is combined with the attenuating stream 414 before entering the guard reactor 418 together with pre-heated fresh feed 410 and a hydrogen rich stream 456.

Another difference is that the fresh feed stream 410 is pre-heated by exchanging heat with the effluent stream 432 from the hydrotreating/hydrocracking reactor 428 in a heat-exchanger 431.

The advantage of this embodiment is that the second stage attenuating stream 436 is more effective in diluting the olefin-rich feed stream 410 because it is even more saturated than the first stage attenuating stream 414. However, there is the risk of excessive cracking of the second stage attenuating stream compounds, thus increasing the light gas yield and reducing the diesel and heavier products yield. Besides, the second stage attenuating stream 436 will result if further cooling of the streams entering the second stage reactors, thus increasing the required duty for heater 430 and thus increasing OPEX. The increased OPEX might be compensated by preheating the fresh feed 410 using excess heat from the second stage reactors effluent with heat-exchanger 431.

This embodiment seems adequate only when the fresh feed 410 is excessively olefinic.

In each of the previous embodiments, there are only one first-stage reactor 22, 122, 222, 322, 422 and only one second-stage reactor 28, 128, 228, 328, 428. However, the present invention also encompasses embodiments wherein there are several first-stage reactors and/or several second-stage reactors arranged in series, with corresponding intermediate intercoolers or liquid quench and hydrogen feed between the first-stage reactors and intermediate hydrogen feeds between the second-stage reactors. Likewise, there are also contemplated to be encompassed by the scope of the present invention embodiments wherein there is one or more multi catalyst bed reactor in the first and/or second stage, with corresponding intermediate intercoolers or liquid quench and hydrogen feed between the first-stage reactor catalyst beds and/or intermediate hydrogen feeds between the second-stage reactor catalyst beds.

The use of multiple reactors in series or reactor with multiple catalyst beds helps to improve the heat management within the reactor stages, enabling the possibility to introduce hydrogen and cool the reaction area more gradually than with a single reactor with a single catalyst bed.

Figure 6:
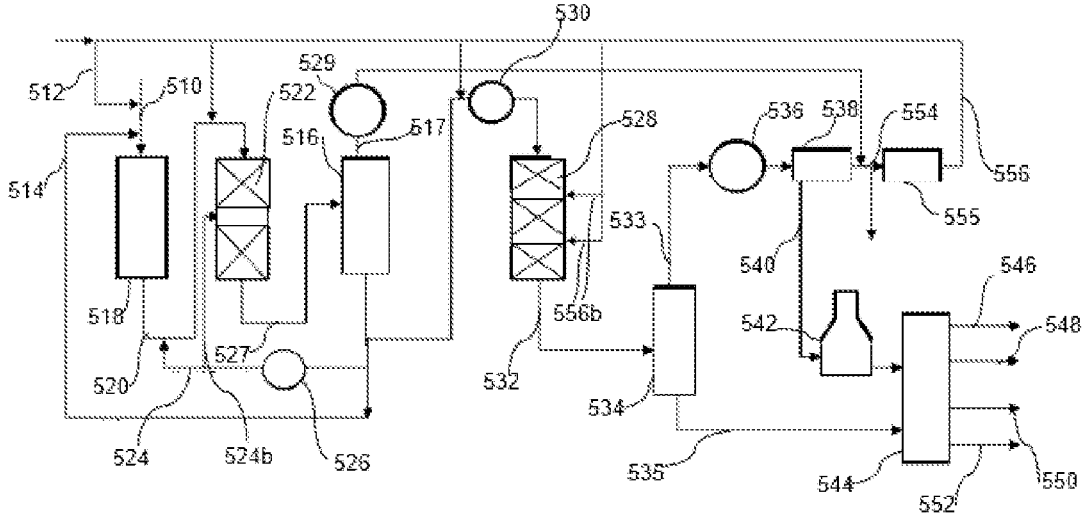
FIG. 6 is a flow diagram of a process according to a sixth embodiment of the invention.

An embodiment with multi catalyst bed reactors is shown in to FIG. 6, wherein the flow diagram illustrates the method according to a sixth embodiment of the invention, which is similar to the first embodiment of invention and wherein like elements are indicated by like numerals incremented by 500. For example, the guard reactor in FIG. 1 is 18, and is 518 in FIG. 6.

There are a few differences between the embodiment in FIG. 1 and the embodiment in FIG. 6, the most important being the first and second stage reactors 522, 528, which in this example are multi bed reactors.

The first stage reactor 522 has two catalyst beds and between the catalyst beds there is a liquid quench feed 524*b*.

The second stage-reactor 528 has three catalyst beds with hydrogen-rich recycle gas feeds 556*b* between beds.

Another important difference from the embodiment in FIG. 1 is that the gas effluent stream 517 from the first stage separator 516 is not sent to the second-stage reactor 528, but instead it is cooled with heat exchanger 529 and mixed with the cold separator 538 vapor stream further downstream. In other words, the gas effluent stream 517 from the first-stage separator 516 by-passes the second stage reactor 528.

By bypassing the second-stage reactor 528 by the gas effluent 517 from the first-stage separator 516, a reduction in cracking reactions experimented by the gas effluent is achieved. This has the benefit that less off-gas loses will be obtained from the overall process, which has a significant impact on the economical profitability of the process.

Another reason for by-passing the second-stage reactor 528 by the gas stream 517 is that mixing a gas stream with a liquid stream before entering the second-stage reactor 528 might be rather difficult and require a custom-designed mixing nozzle. By sending the gas directly to the cold separator 538, this complexity of mixing two-phases is eliminated. It may also be necessary to compress the gas effluent 517 from the first-stage separator 516 in order to mix it with the liquid effluent of the first-stage separator 517. By by-passing the second stage-reactor 528 with the first-stage separator 516 gas effluent 517, additional compression thereof is avoided.

Besides, the vapor phase from the first-stage separator 516 contains mostly hydrogen, which can therefore be recovered and sent to the cold separator 538, from which it is purified by the hydrogen purification unit 555 (PSA), and recycled back to the reactors as recycled hydrogen.

However, the drawback of this bypass is that it increases the sizing of the entire gas recycle section because there is a larger volume of gas being recycled and an additional cooling unit 529 is needed. This increases the cost of the facility (CAPEX).

Also, there is not a dedicated control of the first-stage reactor vapor phase and therefore, there could be variations in the gas composition which could cause a variation in recycle gas composition.

Figure 7:
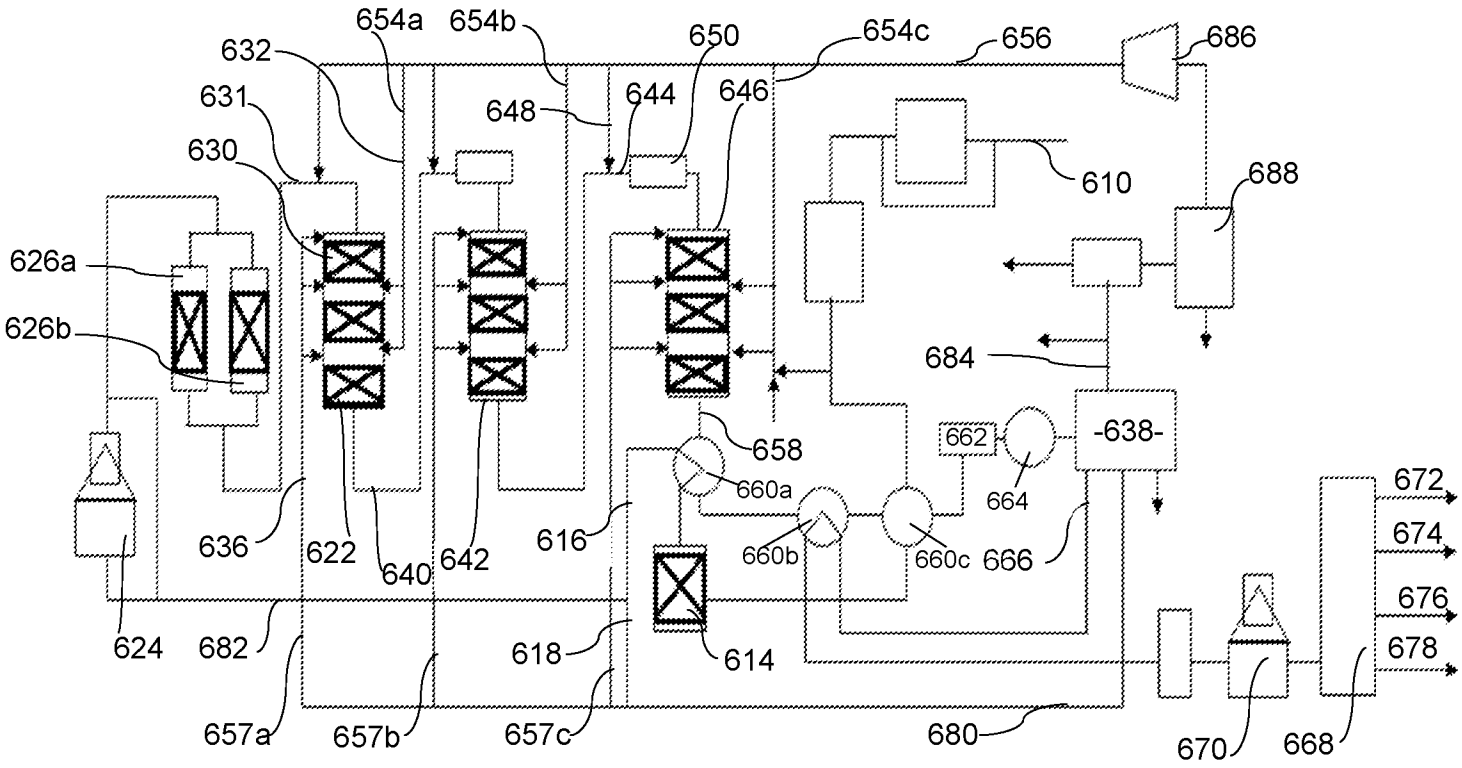
FIG. 7 is a flow diagram of a process according to a seventh embodiment of the invention.

With reference to FIG. 7, the flow diagram illustrates the method according to a seventh embodiment of the invention, which is somewhat similar to the previous embodiments of invention.

This seventh embodiment comprises the steps of:

a) purifying the highly-olefinic pyrolysis oil fresh feed in a purification sub-step comprising coarse filtration to remove entrained solids in the oil to <250 microns particle size, water-washing with 0-5% wt caustic solution remove dissolved HCL and other inorganic chlorides, dewatering via phase separation in a suitable oil/water separator for water content removal, fine filtration in a coalescer to remove entrained particles to <50 microns particle size and further dewatering, further purification via adsorption in a chloride guard vessel loaded with activated carbon or other suitable commercial grade adsorbent material for the dechlorination (organic and inorganic chlorides removal), decoloration and deodorisation of the pyrolysis oil, b) combining the purified oil in step a). or un-purified highly-olefinic pyrolysis oil fresh feed with hydrogen gas to a first hydroprocessing reactor (Dienes Saturation Reactor DSR) operating at mild hydroprocessing conditions (150-190° C., 25-90 Barg, 2-6 LHSV), wherein the hydroprocessing reactor consist of a catalyst bed made up of commercial grade NiMo catalyst, with the primary purpose of saturating the diolefins existing in the fresh feed, and removal of silica in same, c) combining the highly-olefinic diolefins-free pyrolysis oil obtained from the Dienes Saturation Reactor (DSR), with hydrogen gas and a saturated near zero-olefins stream, also known as attenuation or dilution stream, to form an attenuated or diluted feed stream to a second hydroprocessing reactor (Hydrodemetallization Reactor) for the primary purpose of removing organic and inorganic metals from the attenuated feed, d) contacting the demetallized diolefins-free attenuated feed stream from the Demetallization Reactor with a series of hydroprocessing catalysts in a multiple-reactor process with at least two hydroprocessing reactors, wherein a first reactor series of at least one reactor (Olefins Sequential Saturation Reactor(s)) operates at a lower temperature and/or pressure in order to mainly saturate double-bonds (olefins), and at least one second reactor (Hydrotreating, Hydrocracking, Hydrodewaxing and Hydroisomerization Reactor(s) or beds), which operate(s) at higher temperature and/or pressure, in order to mainly remove organic sulphur, metals, oxygen, nitrogen, reduce aromatics content, crack long chain hydrocarbon compounds, dewax and increase small chain and isomerised compounds;

e) splitting the Hydrotreating, Hydrocracking, Hydrodewaxing and or Hydroisomerization Reactor(s) or beds final liquid product after cooling, which is a saturated near-zero-olefins stream, into at least two portions by flashing it in a cold separator vessel; wherein a first portion serves as a recycle stream, and a second portion serves as a feed to a distillation system, f) splitting the first portion in e) into an attenuation or dilution stream for step (c), and a liquid quench stream for temperature control within the reactor beds in step (d).

In this embodiment, the process can be divided in two stages, wherein the first stage serves principally for dienes saturation and silica removal, metals removal and olefins saturation via hydrodemetallisation and hydrodeolefinisation respectively, while the second stage serves mainly for sulfur, nitrogen, oxygen removals, aromatics saturation, cracking, dewaxing and isomerisation via hydrodesulphurisation, hydrodeoxygenation, hydrodearomatisation, hydrocracking, hydrodewaxing and hydroisomerisation reactions correspondingly.

This embodiment has the following features considered and integrated:

A. The proportion of the saturated near-zero-olefins attenuation stream to the unsaturated highly olefinic fresh feed stream is between 1 to 1 and 10 to 1.

B. The higher the proportion of the saturated stream mixing with the fresh feed, the greater the reduction in the potential temperature excursion in the reactor, thus reducing the safety risk and potential for temperature runaway. Also, it improves the catalyst life by reducing the severity of the catalyst operation and likelihood of catalyst deactivation.

C. The mass flow of the feed to the distillation system is similar or as close as possible to the mass flow of the incoming unsaturated highly olefinic fresh feed.

D. The unsaturated highly olefinic pyrolysis oil fresh feed may comprise mainly of pyrolysis or synthetic oil from waste plastics. Optionally, the unsaturated highly olefinic pyrolysis oil fresh feed may comprise a minority part (i.e. less than 50% wt) of pyrolysis or synthetic oil from biogenic feedstock and/or fossil-based hydrocarbon oil.

E. In this context, highly olefinic refers to oils with between 25 to 85% wt olefins content, and "near zero-olefins" refer to between 0 to 10% wt olefins content.

F. The step of splitting the final reactor liquid product streams into a portion that serves as liquid quench, after cooling, for the temperature control within the reactors' beds.

G. The attenuated feed stream comprises at least a portion of the hydrogen gas dissolved in the attenuation (dilution) feed stream, with non-dissolved hydrogen gas comprising between 0.1 to 0.99 volume fraction of the attenuated feed stream (essentially, first diene-free reactor feed vapor fraction is between 0.1 to 0.99).

H. Hydrogen is required for the reaction purposes, but also works to reduce the formation of coke on the catalyst, thus increasing the catalyst lifespan. Higher hydrogen partial pressure also improves the cetane number, increases aromatic saturation, etc.

I. The step of contacting the fresh high-olefinic pyrolysis oil feed stream with NiMo catalysts in a Diolefins Saturation Reactor, for the removal of portion of Silica contained in the feed and for the saturation of dienes and other diolefins in the feed, thereby preventing polymerisation, gum formation and fouling of downstream unit and catalyst beds.

J. The step of contacting the attenuated feed stream with a series of hydroprocessing catalysts in a process with at least two hydroprocessing reactors comprises maintaining a liquid mass flux within the reactors of at least 1 kg/s-m2 to 5 kg/s-m2 to form a hydroprocessed product.

K. The process embodiment comprises providing a commercial system of catalysts in at least one hydroprocessing reactor comprising one or more of the following: a hydrodemetallization catalyst for principally metals removal, a hydrotreating catalyst for principally hydrodesulphurisation (or sulphur removal), hydrodenitrogenation (or nitrogen removal), hydrodearomatisation (for aromatics saturation), hydrodeoxygenation (or oxygen removal), a hydrocracking catalysts, for the cracking of the higher molecular weight higher hydrocarbon chain compounds into smaller hydrocarbon chain compounds for the improvement of the oil's chemical and transport properties, and/or a hydroisomerisation catalyst, for the dewaxing via isomerisation of the oil's longer chain paraffins, thereby further improving the oil's chemical and physical properties.

This seventh embodiment (illustrated in FIG. 7) involves the treating of a waste-plastics-derived pyrolysis oil, optionally purified in a purification system comprising water removal, dissolved acids, salts and metals oxides removal and filtration, in a system of multiple hydroprocessing reactors, whereby the hydroprocessing is separated in two stages. Stage 1 operates at lower temperatures for di-olefins and olefins saturation and demetallization, also allowing for a minimization of cracking, fouling and gum formation in Stage 1; Stage 2 operates at a higher temperature for the removal of sulfur, aromatics, nitrogen and oxygenate compounds in the pyrolysis oil feed, as well as for hydrocracking and hydrodewaxing/hydroisomerisation.

The process involves the addition of a saturated diluent (saturated low olefinic stream with a near-zero olefin content), also called attenuation or dilution stream, to the fresh purified or unpurified high-olefinic fresh feed stream after passing through the Diolefins Saturation Reactor (which may be bypassed if the concentration of diolefins in the purified or unpurified fresh pyrolysis oil feed is significantly low between 0 to 2 wt %), before feeding to the other Stage 1 hydroprocessing reactors system (hydrodemetallization and olefins saturation reactors), as well as the use of the same saturated diluent material to quench the reactors catalyst beds and effluent to control the temperature and reduce the hydrogen consumption in the reactors.

Specifically, a fresh pyrolysis oil feed 610, after mixing with a portion of recycled hydrogen stream 656, is preheated to about 160° C. in the third reactor effluent heat exchanger 612, before routing to a dienes reactor 614 operating at about 160-190° C. with LHSV 4 for fresh feed diolefins saturation and Silica removal. The dienes reactor 614 effluent 616 is mixed with a pre-cooled recycled saturated diluent or attenuation stream 618 (with a proportion of 1:2.5 fresh:dilution stream, offering a reduction of the feed's olefins from 72% wt typical to about 20% wt), and hydrogen (not shown), and then preheated by the first reactor effluent heat exchanger 620 to about 250° C. and sent to the first hydrotreating reactor 622 via a furnace 624 and the Demetallization/Guard reactors 626*a*, 626*b* and operating in swing mode. The inlet temperature is about 316° C. The guard reactors 626*a*, 626*b* primary function is removal of metals, silica and other solid impurities. In the reactors 626*a*, 626*b*, the primary reactions are olefin saturation and demetallisation. Each guard reactor 626*a*, 626*b* typically operates at an LHSV of 2.

To avoid significant exotherm in the first hydrotreating reactor 622, a low activity hydrodeolefination catalyst 630 is used, coupled with a controlled hydrogen supply 632. Furthermore, in order to allow for a higher sink of the heat generated due to the olefins content in the feed 631, the feed to the first hydrotreating reactor 622 is maintained at a much lower temperature (about 240-380° C.), compared to standard refinery hydrotreater/hydrocracker units processing fossil-based crude oils. To control the temperatures within the beds and to prevent temperature excursions, cooled liquid quench 636, which further acts as a diluent within the beds, is used. Typical temperature increments within each bed are maintained at between 15° C. and 40° C. during normal operations. At a temperature increment above 50° C., typically, emergency quench procedures are activated. In cases of emergency, emergency quench liquid (not shown), sub-cooled to 40-50° C. is used. The emergency quench liquid comes from the cold high-pressure separator 638.

Typically, in the first hydrotreating reactor 622, a fraction of the feed olefins is saturated in the first catalyst bed, the effluent of which flows to the next catalyst bed where the same reactions occur, leading to a sequential saturation of the olefins from bed to bed within same first hydrotreating reactor 622. The effluents from the beds are cooled via direct mixing with the liquid quench 636.

The first hydrotreating reactor 622 effluent 640 at about 368° C. and 83 Bar, is routed to the second hydrotreating reactor 642. Electric heater (normally not used) is provided to supply adequate heat to the feed if and when required. Typical inlet temperature to the second hydrotreating reactor 642 is about 350-375° C., and outlet temperature 375-385° C. Stream 644 entering third hydrotreating reactor 646 from the second hydrotreating reactor 642 is either cooled to third hydrotreating reactor 646 inlet temperature using hydrogen quench 648, or heated with electric heater 650 as may be required. The second and third hydrotreating reactors 642, 646 are each designed for an LHSV of 2. Each reactor comes with 3 catalyst beds, with the top bed principally equipped with a commercial high efficiency hydrodesulphurization catalyst, the middle bed—a hydrocracking catalyst, and the bottom bed—a hydrodewaxing/hydroisomerisation catalyst.

Alternatively, the second hydrotreating reactor 642 could be equipped with hydrodesulphurization catalyst, and the third hydrotreating reactor top, middle and bottom beds comprising hydrodesulphurization, hydrocracking and hydrodewaxing/hydrodeisomerization catalysts, respectively. Given that each of these catalysts typically performs multiple hydroprocessing reactions (hydrodesulfurization catalysts for example typically also performs hydrodenitrogenation and hydrodeoxygenation functions), the three catalyst bed system in the second and third hydrotreating reactors sufficiently provide all the hydrogenation reactions required for the upgrading of the pyrolysis oil (hydrodesulphurisation (for sulphur removal), hydrodenitrogenation (for nitrogen removal), hydrodearomatisation (for aromatics saturation), hydrodeoxygenation (for oxygen removal), hydrocracking (for the cracking of the higher molecular weight higher hydrocarbon chain compounds into smaller hydrocarbon chain compounds for the improvement of the oil's chemical and transport properties), and a hydroisomerisation (for the dewaxing via isomerization of the oil's longer chain paraffins).

The first, second and third hydrotreating reactors 628, 642, 646 are supplied with hydrogen streams 654*a*, 654*b*, 654*c* respectively, for the provision of chemically required hydrogen for consumption during the hydrotreating reactions. The first, second and third hydrotreating reactors 628, 642, 646 are further supplied with liquid quench 657*a*, 657*b*, 657*c* respectively, for effective temperature control, additional dilution and diluted hydrogen supply to the reaction beds.

The effluent from the third hydrotreating reactor 658, typically a hydroprocessed saturated stream exiting at about 385° C. and 78 Bar, is routed to the cold high-pressure separator 638 via heat exchangers 660*a*, 660*b*, 660*c*, air cooler 662 and water trim cooler 664. The cold high-pressure separator 638 operates at 40° C. to ensure maximum disengagement of the dissolved hydrogen in the cooled liquid, thereby minimizing hydrogen loss in the stream 666 routed to the distillation column 668. The stream 666 routed to distillation, via heat exchanger and furnace 670, is controlled such that the overall flow equals or very closely equates to the incoming fresh feed flowrate 610. Off-gas 672, naphtha 674, diesel 676 and fuel oil 678 are products from the distillation column 668.

The saturated diluent 680 is recycled via the cold high-pressure separator vessel 638 located downstream of the third hydrotreating reactor 646, and mixed with the fresh feed 616 coming from the dienes reactor 614. The blending of the fresh unsaturated highly olefinic pyrolysis oil feed 616 with a saturated stream 680 acting as diluent (attenuation stream), reduces the olefinic content in the total feed stream 682 to the Stage 1 first hydrotreating reactor 622 and thereby reduces the degree of exotherm in this and subsequent reactors.

The liquid quench 657*a*, 657*b*, 657*c* to the first, second and third hydrotreating reactors 628, 642, 646 are the same material as the recycle saturated diluent 680.

The gas phase 684 from the cold high-pressure separator 638 is routed to the recycle hydrogen compressor 686 via a hydrogen purification unit 688. The purified hydrogen is compressed back as recycle gas 656, mixed with fresh hydrogen makeup, and routed to the dienes, guard, first, second and third hydrotreatment reactors 614, 626*a*, 626*b*, 628, 642, 646.

The operating conditions of temperature, pressure, hydrogen to oil ratio, liquid hourly space velocity (LHSV), weighted average bed temperature (WABT), temperature rise and catalyst type are selected such that the fraction of olefins in the fresh feed is saturated in the Stage 1 first hydrotreatment reactor 628.

According to our knowledge, the use of diluent recycle feed to attenuate highly olefinic fresh waste plastic pyrolysis oil for the upgrade of this types of oil has not been carried out previously. There are different processes available for hydrotreating pyrolysis oils but none that uses a portion of the saturated partial product from the HP separator to attenuate (dilute) the high olefins content in the feed, ensuring that the olefin concentration in the fresh feed is reduced and thereby reducing the degree of exothermicity of the olefin saturation reactions in the reactors. Use of liquid quench as a substitute for hydrogen quench also reduces the requirement for hydrogen without affecting hydrogen chemical consumption, which is an advantage economically. Liquid quench is vastly different to standard gas quench used in conventional hydroprocessing.

The advantage of the invention is that the attenuation stream reduces the olefin concentration in the reactor feed and therefore reduces the degree of exotherm of the olefin saturation reactions in the reactors. This also acts as an effective temperature control. Further advantages are that use of liquid quench reduces the hydrogen consumption in the reactor. The liquid quench also provides greater heat capacity. Overall, the heat management of the process is improved, the hydrogen consumption is reduced and the system is inherently safer.

Further leveraging on pilot-plant-data driven parametric design of the above elaborated process, results obtained have confirmed the fit-for-purpose of the seventh embodiment process at providing adequate solution to the key challenges found in pyrolysis oil use as fuel.

Example 1

In this example, the hydro-upgrading of two pyrolysis oils subjected to two different process conditions is presented.

Table 1 shows the properties of two pyrolysis oils used as starting material.

Table 2 shows the hydro-treating conditions used to upgrade the pyrolysis oils. Oil A has been treated with the less severe conditions and oil B has been treated with the more severe conditions.

TABLE 1

Properties of starting pyrolysis oils: Oil A and Oil B.

| Properties | Feed A | Feed B |
|---|---|---|
| Density (@15 C.), kg/m3 | 779.4 | 806.4 |
| Carbon, % | 85.68 | 85.49 |
| Hydrogen, % | 13.31 | 13.14 |
| Oxygen, % | 1.00 | 1.34 |
| Sulfur, wtppm | 35 | <100 |
| Nitrogen, wtppm | 100 | — |
| Viscosity (@20 C.), cSt | 2.265 | 5.061 |
| IBP, C. | 38.8 | 70 |
| FBP, C. | 576.6 | —* |
| Olefins, vol % | 61.2 | 72.5 |
| Aromatics, vol % | 12.0 | 4.8 |

*80% Recovery at 377 C.

TABLE 2

Hydro-treating conditions used to upgrade the pyrolysis oils A (low severity) and B (high severity).

| Operating Parameters | Low Severity | High Severity |
|---|---|---|
| Temperature, C. | 300 | 375 |
| Pressure, barg | 44 | 83 |
| LHSV, $hr^{-1}$ | 2 | 1 |
| H2/HC ratio, SCFB | 2500 | 5000 |
| Hydrogen purity, mol % | 90 | 99 |

TABLE 3

Fuel properties after the pyrolysis oil A hydro-upgrading.

| Properties | Naphtha | Diesel | Fuel Oil |
|---|---|---|---|
| Density (@15 C.), kg/m3 | 740.2 | 791.7 | 816.8 |
| IBP, C. | 63.8 | 212.2 | — |
| FBP, C. | 251.6 | 363.1 | — |
| Viscosity (@20 C.), cSt | 0.906 | — | — |
| Viscosity (@40 C.), cSt | — | 2.679 | — |
| Viscosity (@50 C.), cSt | — | — | 9.462 |
| Sulfur, wtppm | 1.0 | <3 | 25 |
| Nitrogen, wtppm | 0.4 | — | — |
| Vapor Pressure, kPa | 13.4 | — | — |
| Paraffins, vol % | 75.2 | — | — |
| Olefins, vol % | 0.6 | — | — |
| Naphthenes, vol % | 20.2 | — | — |
| Aromatics, | 3.4 vol % | 2.2 wt % | — |
| Pour Point, C. | — | −6 | 33 |
| Flash Point, C. | — | 71 | >85 |
| Cetane Index | — | 72.8 | — |
| Bromine Number | 0.2 | <0.5 | 0.32 |

TABLE 4

Fuel properties after the pyrolysis oil B hydro-upgrading.

| Properties | Naphtha | Diesel | Fuel Oil |
|---|---|---|---|
| Density (@15 C.), kg/m3 | 744.0 | 797.6 | 821.5 |
| IBP, C. | 61.7 | 229.0 | — |
| FBP, C. | 195.5 | 332.4 | — |
| Viscosity (@20 C.), cSt | 0.651 | — | — |
| Viscosity (@40 C.), cSt | — | 2.157 | — |
| Viscosity (@50 C.), cSt | — | — | 11.86 |
| Sulfur, wtppm | 7.6 | 4.6 | 35 |
| Nitrogen, wtppm | 1.8 | 2.3 | — |
| Vapor Pressure, kPa | 13.3 | — | — |
| Paraffins, vol % | 70.8 | — | — |
| Olefins, vol % | 0.5 | — | — |
| Naphthenes, vol % | 24.1 | — | — |
| Aromatics, | 4.7 vol % | 4.9 wt % | — |
| Pour Point, C. | — | −15 | 45 |
| Flash Point, C. | — | >85 | >85 |
| Cetane Index | — | 74.8 | — |
| Bromine Number | — | 0.35 | 0.32 |

Tables 3 and 4 show the properties of the fuels obtained after the hydro-treating of pyrolysis oil A and B at the different hydro-treatment conditions.

It is clearly seen how these hydro-upgrading processes reduce the olefin content in the fuel products to almost zero, as well as the sulphur and nitrogen amounts.

Additionally, the resulting fuel products have more commercial value due to their properties than the pyrolysis oils, which have properties which are not within the commercial fuel properties ranges.

The invention claimed is:

1. A method of waste plastics pyrolysis oil upgrading via hydroprocessing comprising the steps of:

a) combining a highly-olefinic pyrolysis oil liquid feed with hydrogen gas and a saturated near zero-olefins stream to form an attenuated feed stream to a first hydroprocessing reactor, b) contacting the attenuated feed stream with a series of hydroprocessing catalysts in a two-stage process with at least two hydroprocessing reactors, wherein a first reactor series of at least one reactor operates in the first stage at a lower temperature and/or pressure than the second stage in order to mainly saturate double-bonds and at least one second reactor, which operate(s) in the second stage, at higher temperature and/or pressure than the first stage, in order to mainly remove hetero-atomic compounds;

c) splitting the product of the first stage reactor, which is a saturated near-zero olefins stream, into at least two portions by flashing it on a separator vessel; wherein a first portion serves as the attenuation stream in step a), and a second portion serves as feed to the second stage.

2. The method according to claim 1 wherein the proportion of the saturated near-zero-olefins stream to the unsaturated highly olefinic stream is between 1 to 1 and 10 to 1 in weight.

3. The method according to claim 1 wherein the mass flow of the feed to the second stage is similar or as close as possible to the mass flow of the incoming unsaturated highly olefinic feed.

4. The method according to claim 1 wherein the unsaturated highly olefinic pyrolysis oil liquid feed comprises mainly pyrolysis or synthetic oil from waste plastics.

5. The method according to claim 1 wherein the unsaturated highly olefinic pyrolysis oil liquid feed comprises a minority part of pyrolysis or synthetic oil from biogenic feedstock and/or fossil-based hydrocarbon oil.

6. The method according to claim 1 wherein the step of splitting the product of the first stage reactor or one of the at least one second reactor yields a third portion that serves as liquid quench, after cooling, for the temperature control within the first and/or second stage reactor(s).

7. The method according to claim 1 wherein the attenuated feed stream comprises at least a portion of the hydrogen gas dissolved in the attenuated feed stream, with non-dissolved hydrogen gas comprising between 0.1 to 0.99 volume fraction of the attenuated feed stream.

8. The method according to claim 1 wherein the step of contacting the attenuated feed stream with a series of hydroprocessing catalysts in a two-stage process with at least two hydroprocessing reactors comprises maintaining a liquid mass flux within the reactors of at least 1 kg/s-$m^2$ to 5 kg/s-$m^2$ to form a hydroprocessed product.

9. The method according to claim 1 wherein the at least one second stage hydroprocessing reactor comprises one or more of the following: a hydrotreating catalyst; a hydrocracking catalyst; and/or a hydro-isomerisation catalyst.

10. A system of catalysts in at least one second stage hydroprocessing reactor comprising one or more of the following: a hydrotreating catalyst, a hydrocracking catalyst, and/or a hydro-isomerization catalyst operable to perform the process of claim 1.

* * * * *